US007559196B2

(12) United States Patent
Inoue et al.

(10) Patent No.: US 7,559,196 B2
(45) Date of Patent: Jul. 14, 2009

(54) EXHAUST SYSTEM OF AN INTERNAL COMBUSTION ENGINE

(75) Inventors: Takao Inoue, Kanagawa (JP); Sunki I, Hwa-Sung (KR); Motoharu Akaba, Kanagawa (JP); Kimiyoshi Nishizawa, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 9 days.

(21) Appl. No.: 11/502,198

(22) Filed: Aug. 10, 2006

(65) Prior Publication Data

US 2007/0095052 A1 May 3, 2007

(30) Foreign Application Priority Data

Aug. 11, 2005 (JP) ..... 2005-232740

(51) Int. Cl.
*F01N 3/00* (2006.01)

(52) U.S. Cl. ..... 60/288; 60/313; 60/323; 60/324

(58) Field of Classification Search ..... 60/313, 60/323, 324, 287, 288
See application file for complete search history.

(56) References Cited

U.S. PATENT DOCUMENTS

| | | | | |
|---|---|---|---|---|
| 3,823,555 | A | 7/1974 | Cole | |
| 5,072,583 | A * | 12/1991 | Urushihara et al. | 60/313 |
| 5,144,800 | A * | 9/1992 | Shioya et al. | 60/323 |
| 2002/0062642 | A1* | 5/2002 | Dini et al. | 60/288 |
| 2005/0268600 | A1* | 12/2005 | I et al. | 60/288 |

FOREIGN PATENT DOCUMENTS

| | | | |
|---|---|---|---|
| EP | 0 556 854 | A1 | 8/1993 |
| EP | 0 653 551 | A2 | 5/1995 |
| EP | 1 057 984 | A2 | 12/2000 |
| EP | 1 103 701 | A2 | 5/2001 |
| EP | 1 188 909 | A2 | 3/2002 |
| EP | 1 605 145 | A1 | 12/2005 |
| JP | 05-321644 | | 12/1993 |
| JP | 05 321644 | A | 12/1993 |
| JP | 06-101462 | A | 4/1994 |
| JP | 06 159045 | A | 6/1994 |
| JP | 07-22016 | * | 4/1995 |

OTHER PUBLICATIONS

EP Search Report No. 06253980.4-1263 dated Dec. 29, 2006.

* cited by examiner

*Primary Examiner*—Thomas E Denion
*Assistant Examiner*—Diem Tran
(74) *Attorney, Agent, or Firm*—Global IP Counselors, LLP

(57) ABSTRACT

An exhaust system of the internal combustion engine comprises upstream main paths for cylinders that are attached to a side of a cylinder head and extend towards a side of the engine, and are connected to the respective cylinders; a downstream main path in which the upstream main paths join so as to become one flow path; a main catalytic converter provided on the downstream main path; bypasses that are split from the upstream main paths or the downstream main path; a bypass catalytic converter that is provided on the bypass; and flow path switching valves that open and close the upstream main paths so that exhaust discharged from the cylinders flows into the bypass. The bypass catalytic converter is provided below the upstream main paths.

17 Claims, 4 Drawing Sheets

EXHAUST SYSTEM OF AN INTERNAL COMBUSTION ENGINE

CROSS-REFERENCES TO A RELATED APPLICATION

This application claims priority from Japanese Patent Application Serial No. 2005-232740 filed Aug. 11, 2005, the contents of which are incorporated herein by reference in its entirety.

TECHNICAL FIELD

Described herein is an exhaust system of an internal combustion engine that carries out purification of exhaust by a catalytic converter, and in particular, an improvement of the exhaust system by guiding the exhaust to a bypass having another catalytic converter, immediately after a cold start and when a main catalytic converter is not activated.

BACKGROUND

In a conventional system, a main catalytic converter is arranged on the downstream side of an exhaust system, such as below a vehicle body floor. In such a system, a sufficient exhaust purification cannot be expected after a cold start of the internal combustion engine and until the temperature of the catalytic converter rises so that the converter is activated. In addition, the closer to the upstream side of the exhaust system the catalytic converter is, namely to the internal combustion engine side, the more problems there are with decreased durability due to the thermal deterioration of the catalyst of the converter.

Therefore, as disclosed in Japanese Laid Open Patent No. H05-321644, an exhaust system has been proposed in which a bypass is provided in parallel to an upstream side portion of the main path having the main catalytic converter, and another bypass catalytic converter is provided on the bypass, and a switching valve for switching these paths are provided therebetween so that the exhaust is guided to the bypass immediately after a cold start. With this structure, the bypass catalytic converter is positioned on the upstream side of the main catalytic converter in the exhaust system and is activated at a relatively early stage so that exhaust purification can be started from the earlier stage.

According to the conventional exhaust system, the bypass splits from the main path, downstream of the confluence point of the exhaust manifold. In other words, the main path and the bypass are parallel, downstream of the confluence point at which the exhaust paths extending from respective cylinders of a multiple cylinder internal combustion engine are joined together, so that the device becomes large, and in particular, when the bypass catalytic converter is provided close to the internal combustion engine, it is difficult to provide the converter in the engine room of the vehicle.

SUMMARY

The present exhaust system of the internal combustion engine comprises upstream main paths for cylinders that are attached to a side of a cylinder head and extend towards a side of the engine, and are connected to the respective cylinders, a downstream main path in which the upstream main paths join so as to become one flow path, a main catalytic converter provided on the downstream main path, bypasses that are split from the upstream main paths or the downstream main path, a bypass catalytic converter that is provided on the bypass, and flow path switching valves that opens and closes the upstream main paths so that exhaust discharged from the cylinders flows into the bypass. The bypass catalytic converter is provided below the upstream main paths.

According to the present invention, the entire system can be compact by effectively using the dead space under the exhaust manifold.

BRIEF DESCRIPTION OF DRAWINGS

Other features and advantages of the present exhaust system will be apparent from the ensuing description, taken in conjunction with the accompanying drawings, in which.

DETAILED DESCRIPTION

While the claims are not limited to the illustrated embodiments, an appreciation of various aspects of the exhaust system is best gained through a discussion of various examples thereof.

Description of the exhaust system which is applied to an inline 4-cylinder internal combustion engine will be given below as an example, by referring to drawings.

Figure 1:
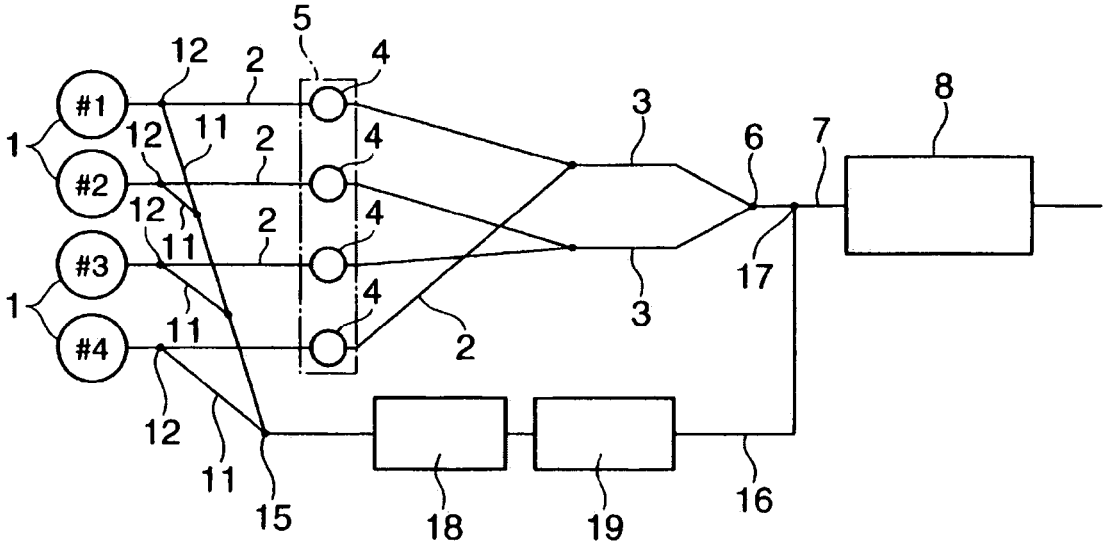
FIG. 1 is a schematic view of an exhaust system.

FIG. 1 is a schematic view of the exhaust system. The structure of the entire exhaust system is described, referring to FIG. 1.

The cylinders 1 (#1 to #4) that are arranged in a line are connected to respective upstream paths 2. Among the four cylinders, the upstream main path 2 for the cylinder #1 and the upstream main path 2 for the cylinder #4, in which the exhaust processes are not continued, are joined together so as to become a single middle main path 3, and similarly, the upstream main path 2 for the cylinder #2 and the upstream main path 2 for the cylinder #3, in which the exhaust processes are not continued, are joined together so as to become a single middle main path 3. Here, in each of the upstream main paths 2, a flow path switching valve 4 is provided. These flow path switching valves 4 are closed during a cold period, and further the four flow path switching valves 4 are provided as a single valve unit 5 so that all of the cylinders are opened and closed at the same time.

The two middle main paths 3 that are provided, downstream of the flow path switching valves 4, are joined together at a confluence point 6, so as to become a single downstream side main path 7. A main catalytic converter 8 is provided on the downstream main path 7. The main catalytic converter 8 has catalysts such as three-way catalyst and an HC trap catalyst. This main catalytic converter 8 has a large capacity and is arranged on undersurface of the vehicle floor. The upstream main paths 2, the middle main paths 3, the downstream main path 7, and the main catalytic converter 8 form a main path where the exhaust flows during the normal operation. These main paths have a pipe layout in which they are joined together in, as known as a "four-two-one form" in the inline 4-cylinder internal combustion engine, and therefore, the filling efficiency is improved by the dynamic exhaust effect.

On the other hand, an upstream bypass 11 is split from each of the upstream main paths 2 as a bypass. These upstream bypasses 11 have a sufficiently smaller cross-sectional path area than that of the upstream main path 2. A confluence point 12, which is located at the upstream end of each of the paths, is positioned as upstream as possible on the upstream main path 2. The upstream bypasses 11 for the four cylinders are eventually joined together so as to become a single downstream bypass 16 at a confluence point 15. It is important that the entire length of the bypass (the total sum of the bypasses for each cylinder) is short so that the thermal capacity of the pipe themselves and the heat loss area to the external atmosphere are small. As described later, the upstream bypasses 11 for the cylinders #2, #3, and #4 are connected at an approximately right angle to the upstream bypass 11 for the cylinder #1, which extends from the confluence point 12 of the cylinder #1 in the direction of the cylinder arrangement.

The downstream end of the downstream bypass 16 is joined together with the downstream main path 7 at a confluence point 17, which is on the upstream side of the main catalytic converter 8 provided on the downstream main path 7. Additionally, a bypass catalytic converter 18 using a three-way catalyst is provided on the downstream bypass 16. This bypass catalytic converter 18 is provided as upstream as possible on the bypass 16. According to the present embodiment, a secondary bypass catalytic converter 19 having an individual casing is provided in series on the downstream side of the bypass catalytic converter 18. The bypass catalytic converter 18 and the secondary bypass catalytic converter 19 have a smaller capacity than that of the main catalytic converter 8 in which preferably, a catalyst with a superior low temperature performance is used. Different catalysts may be used for these two bypass catalytic converters 18 and 19.

FIG. 1 is merely an explanatory diagram to illustrate the flow of the exhaust, which does not show the accurate position of each part in an actual internal combustion engine. Although in FIG. 1, the bypass catalytic converter 18 is shown in parallel to the main converter 8, the bypass catalyst converter 18 is provided approximately at right angle with respect to the main converter 8, and is provided in the cylinder arrangement direction.

According to the exhaust system having the above-mentioned structure, when the engine temperature or the exhaust temperature is low after a cold start, the flow path switching valves 4 are closed by the an appropriate actuator, so that the main path is covered. Therefore, all the exhaust discharged from the cylinders 1 flows through the bypass catalytic converter 18 from the confluence points 12 and the upstream bypasses 11. The bypass catalytic converter 18 is positioned on the upstream side of the exhaust system, namely at a position close to the cylinders 1 so that it is compact, and it can be activated immediately and the exhaust purification is started at an early stage. In addition, at this time, the flow path switching paths 4 are closed so that the upstream main paths 2 for the respective cylinders 1 are disconnected from each other. Therefore, they prevent the exhaust discharged from the cylinders from flowing into the upstream main path 2 for other cylinders, and therefore the reduction of the exhaust temperature due to this phenomenon is certainly avoided. At a minimum, the number of the upstream portions of the bypasses is the same as that of the cylinders, and they are split on the upstream side of the confluence point of the upstream main path. Therefore it is possible to position the bypass catalytic converter on the upstream side without restriction as to the position of the confluence point of the main path. In addition, since the splitting points thereof on the bypass side are close to the cylinders, the exhaust flows into the bypass without being relatively affected by the cooling effect due to the thermal capacity of the main path (exhaust manifold).

After the engine is warmed up, the engine temperature or the exhaust temperature become sufficiently high, and then the flow path switching valves 4 are opened. The exhaust discharged from the cylinders 1 mainly flows from the upstream main paths 2 to the downstream main path 7 and then flows through the main catalytic converter 8. Although at this time, the bypass is not particularly blocked, since the cross-sectional area of the bypass is smaller than the main path and the bypass catalytic converter 18 and the secondary bypass catalytic converter 19 are positioned in the middle, a majority of the exhaust flows through the main path and barely flows to the bypass due to the difference in the air flow resistance thereof, so that the thermal deterioration of the bypass catalytic converter 18 is sufficiently restrained. In addition, the bypass is not completely blocked, so that during a high-speed high-load period when the amount of the exhaust is large, part of the exhaust flows through the bypass, thereby avoiding the reduction of the filling efficiency due to the back pressure.

Figure 2:
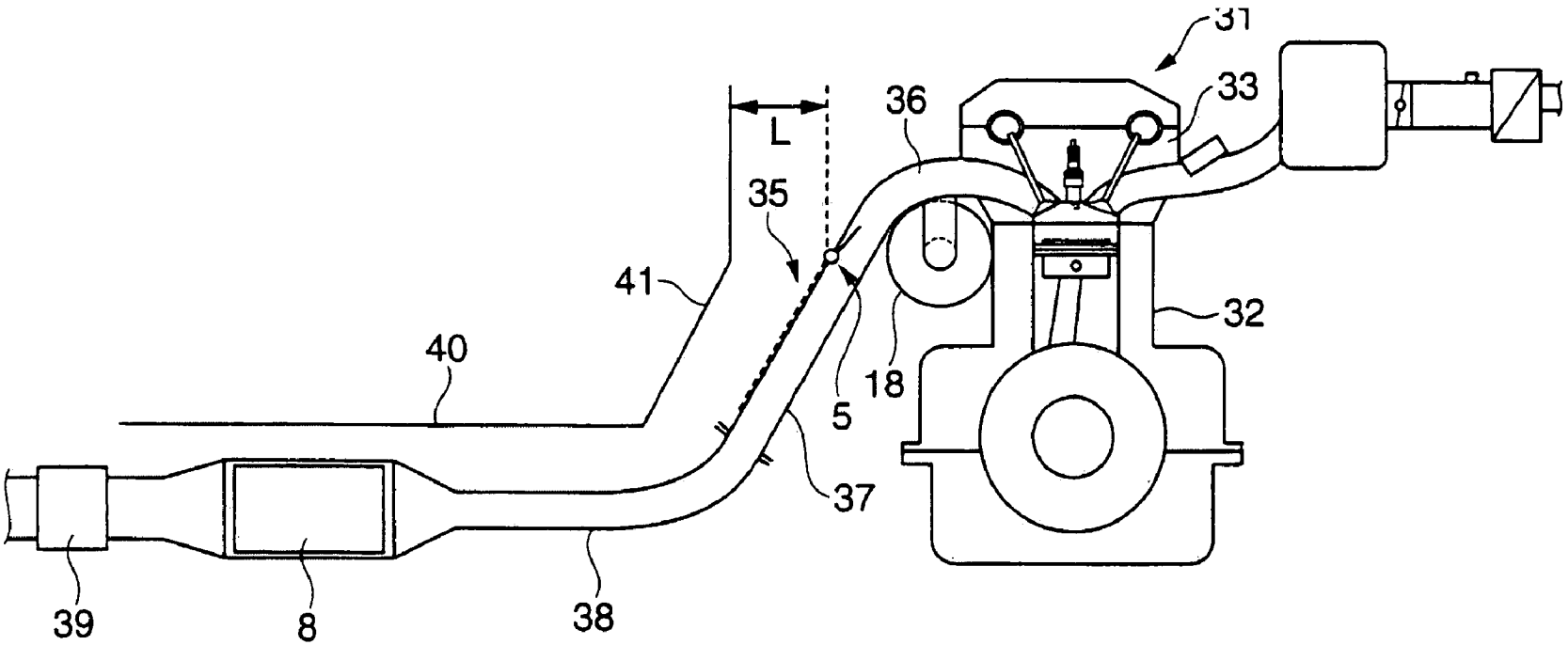
FIG. 2 is a side view of an exhaust system that is installed in a vehicle.

FIG. 2 shows the detailed structure of the exhaust system which is installed in a vehicle. The inline 4-cylinder internal combustion engine 31 that comprises a cylinder block 32 and a cylinder head 33, is mounted in the engine room at the front portion of the vehicle in the so-called transverse manner, and an exhaust manifold 35 having four branch pipes 36, which are equivalent to the upstream main paths 2, is mounted on a side of the cylinder head 33 towards the rear side of the vehicle. The exhaust manifold 35 comprises a valve unit 5 in a middle portion thereof, in which the valve unit 5 has the flow path switching valves 4. The pipes are joined together so as to become one flow path as an outlet pipe 37. Additionally, a front tube 38 having the main catalytic converter 8, which is equivalent to the downstream main path 7, is connected to the outlet pipe 37. This exhaust system, as a whole, extends from the internal combustion engine 31 to the rear side of the vehicle. A silencer 39 is provided, downstream of the main catalytic converter 8.

Here, the main catalytic converter 8 is provided on the undersurface of the vehicle floor panel 40 with the silencer 39. In addition, the exhaust manifold 35 extends obliquely downward from the height of the cylinder head 33 to the height of the underfloor, along the dash panel 41 of the vehicle body. In particular, the upstream portion of each of the branch pipes 36, which are connected to the cylinder head 33, has an arched shape so that it smoothly heads downward. Additionally, a bypass catalytic converter 18 is provided in a space below the branch pipes 36 of the exhaust manifold 35 as high as possible between the exhaust manifold 35 and a side of the cylinder block 32. The bypass catalytic converter 18, which has an approximately cylindrical shape, has the inlet and outlet portions, at both ends thereof. The inlet portion is positioned below a branch pipe at one end of the internal combustion engine 31, and the outlet portion is positioned below a branch pipe at the other end of the internal combustion engine 31. The axis of the flow extends along the cylinder arrangement direction of the internal combustion engine 31 (in the direction of the crankshaft). Thus, the bypass catalytic converter 18 with the approximately cylinder shape is surrounded by the branch pipes 36 around the upper arch portion thereof. A space L is provided between the exhaust manifold 35 and the dash panel 41 in order to prevent thermal damage and to secure collision safety.

Figure 3:
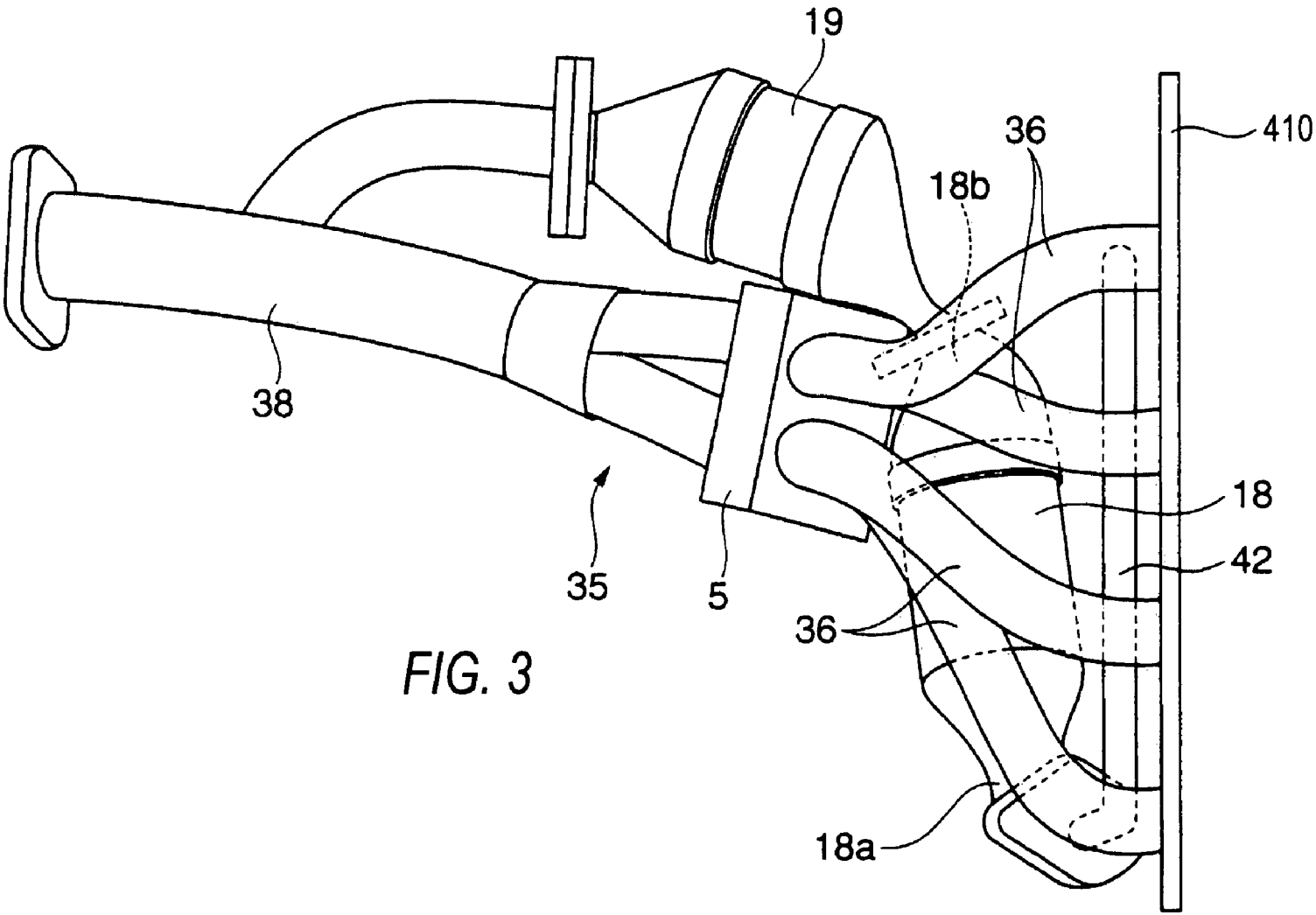
FIG. 3 is a plan view of an exhaust manifold.
Figure 4:
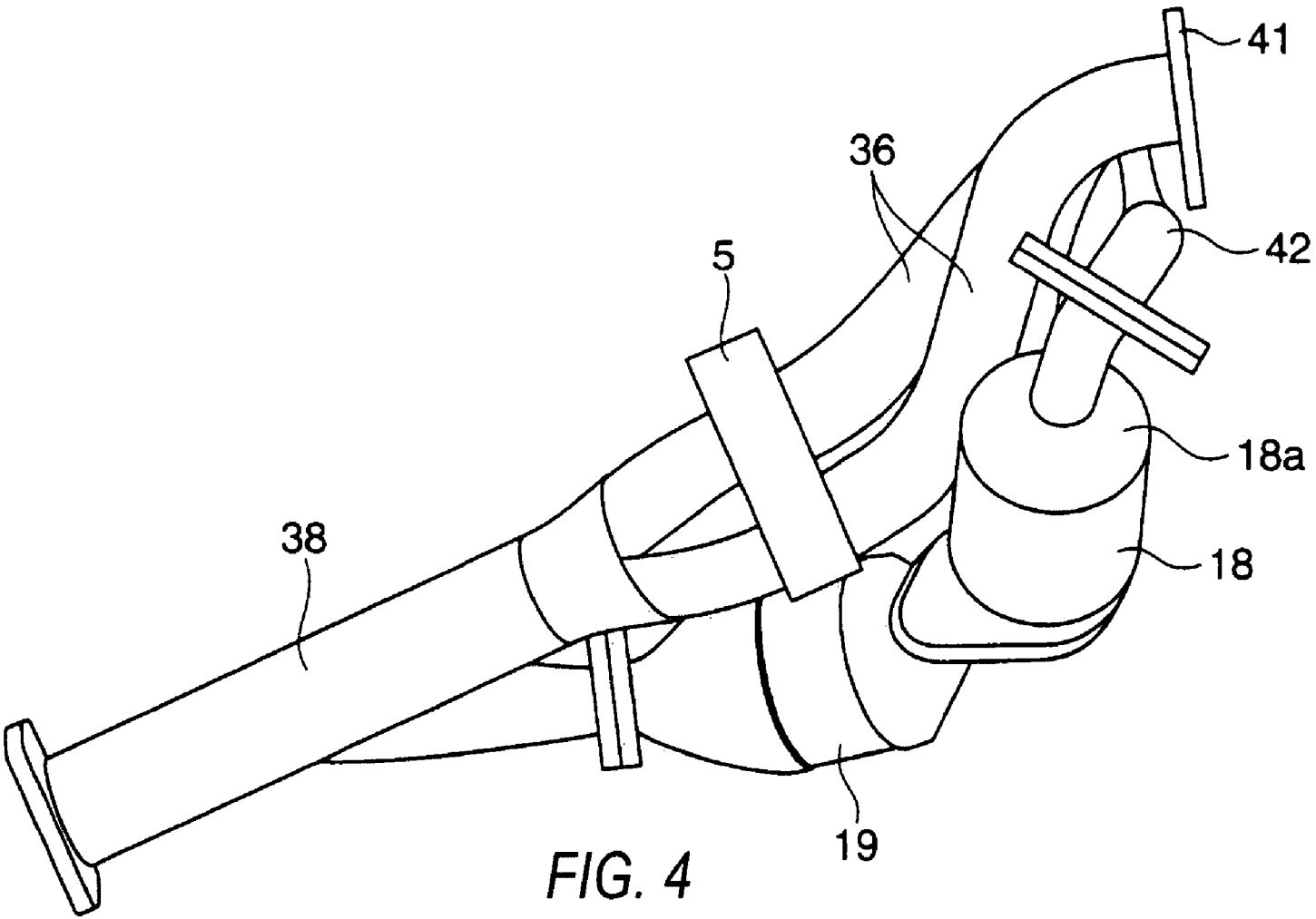
FIG. 4 is a side view thereof.

FIGS. 3 and 4 show the detailed structure of the above-mentioned exhaust manifold 35 in which FIG. 3 is a plan view and FIG. 4 is a side view thereof. The valve unit 5 has a flow path switching valve 4 around each of apexes of the square, and each of the four branch pipes 36 is connected to the flange 410 for attachment of the cylinder head at the upstream end thereof, and the downstream end thereof are connected to the valve unit 5. As described above, the approximately cylinder-shaped bypass catalytic converter 18 is provided below the four branch pipes 36. The bypass pipe 42 that is equivalent to the upstream bypass 11 extending from the cylinder #1, extends below the above-mentioned branch pipes 36 in parallel to the flange 410, that is, in the direction of the cylinder attachment. This bypass pipe 42 is, as shown in FIG. 4, connected to the respective upstream ends of the branch pipes 36. The end of the bypass pipe 42 that extends from one end of the cylinder (for example the #1 cylinder) to the other end (for example the #4 cylinder) in its attachment direction is bent back in a U-turn shape and connected to the inlet portion 18*a* of the bypass catalytic converter 18. As described above, the inlet portion 18*a* of the bypass catalytic converter 18 that is arranged in the cylinder arrangement direction is positioned near the cylinder #4 and an outlet portion 18*b* on the other end is positioned near the cylinder #1. In other words, the bypass catalytic converter 18 is positioned below the branch pipes 36 so that the space in the direction of the cylinder arrangement direction, in which the four branch pipes 36 are arranged, can be used as much as possible. The secondary bypass catalytic converter 19 is connected to the outlet portion 18*b* in a bent shape towards the rear side of the vehicle. The secondary bypass catalytic converter 19 is provided on a side of the valve unit 5 and below the valve unit 5.

As described above, the bypass catalytic converter 18 is provided below the exhaust manifold 35 along the cylinder arrangement direction, as described above, so that the dead space formed between the exhaust manifold 35 and the cylinder block 32 can be efficiently utilized. The main paths 2 (branch pipes 36 and front tube 38) that extend from the cylinder head 33 to a portion under the floor cannot be extremely bent because the path resistance at the maximum output has to be taken into account. Therefore, since the main path 2 is formed so as to curve smoothly and obliquely downwards from the cylinder head 33, a relatively large space is easily formed between a side of the cylinder block 32 and the exhaust manifold 35. Consequently, by using this space for the bypass catalytic converter 18, the entire system can become compact. In particular, since the bypass catalytic converter 18 is placed along the direction of the cylinder arrangement, the bypass catalytic converter 18 can have a sufficiently large capacity in a limited space. As described above, although when the bypass catalytic converter 18 is placed along the cylinder arrangement direction, the exhaust flow greatly bends multiple times, this path resistance of the bypass side does not affect the maximum output of the engine. Further, since a period in which the bypass is used is short, it does not cause a substantial problem. According to the above-mentioned structure, the bypass catalytic converter 18 is provided very close to the exhaust ports, so that the exhaust that exits from the exhaust port can immediately flow into the bypass catalytic converter 18 via the bypass pipes 42. Therefore, the thermal capacity of the exhaust path to the bypass catalytic converter 18 and the heat loss to the outside are minimized and the exhaust purification by the bypass catalytic converter 18 can be started at an early stage.

The preceding description has been presented only to illustrate and describe exemplary embodiments of the methods and systems of the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. An exhaust system of the internal combustion engine comprising:

upstream main paths for cylinders that are attached to a side of a cylinder head and extend towards a side of the engine, and are connected to the respective cylinders;

a downstream main path in which the upstream main paths join so as to become one flow path;

a main catalytic converter provided on the downstream main path;

bypasses that are split from the upstream main paths or the downstream main path;

a bypass catalytic converter that is provided on the bypass; and flow path switching valves that open and close the upstream main paths so that exhaust discharged from the cylinders flows into the bypass, the bypass catalytic converter being provided below the upstream main paths, the bypass catalytic converter being arranged so that the exhaust flows in the bypass catalytic converter along a cylinder arrangement direction where an inlet portion of the bypass catalytic converter is positioned on a side of a first cylinder which is on one end of the combustion engine and an outlet portion of the bypass catalytic converter is positioned on a side of a second cylinder which is on the other end of the combustion engine.

2. The exhaust system according to claim 1, wherein the bypasses comprise upstream bypasses that are split from the upstream portions of the upstream main paths and a downstream bypass in which the upstream bypasses join together so as to become one flow path, and a bypass catalytic converter is provided on the downstream bypass.

3. The exhaust system according to claim 1, wherein the internal combustion engine is transversely mounted on a front portion of the vehicle, and an exhaust manifold is attached to a side of the engine so as to be provided towards a rear side of the vehicle.

4. The exhaust system according to claim 1, wherein the bypass catalytic converter is in a cylinder shape.

5. An exhaust system of the internal combustion engine comprising:

upstream main paths for cylinders that are attached to a side of a cylinder head and extend towards a side of the engine, and are connected to the respective cylinders;

a downstream main path in which the upstream main paths join so as to become one flow path;

a main catalytic converter provided on the downstream main path;

bypasses that are split from the upstream main paths or the downstream main path;

a bypass catalytic converter that is provided on the bypass; and flow path switching valves that open and close the upstream main paths so that exhaust discharged from the cylinders flows into the bypass, the bypass catalytic converter being provided below the upstream main paths, the bypass catalytic converter extending in a cylinder arrangement direction of the internal combustion engine, and an inlet portion of the bypass catalytic converter is positioned near one end of the internal combustion engine below the upstream main paths, and an outlet portion is positioned near the other end of the internal combustion engine below the upstream main paths.

6. An exhaust system of the internal combustion engine comprising:

upstream main paths for cylinders that are attached to a side of a cylinder head and extend towards a side of the engine, and are connected to the respective cylinders;

a downstream main path in which the upstream main paths join so as to become one flow path;

a main catalytic converter provided on the downstream main path;

bypasses that are split from the upstream main paths or the downstream main path;

a bypass catalytic converter that is provided on the bypass, the bypass catalytic converter being provided below the upstream main paths;

flow path switching valves that open and close the upstream main paths so that exhaust discharged from the cylinders flows into the bypass; and an exhaust manifold extending obliquely downwards from a side of the cylinder head of the internal combustion engine so as to be placed along a dash panel of the vehicle, the bypass catalytic converter is provided in a space formed by the upstream main paths and the side of the cylinder head.

7. An exhaust system of the internal combustion engine comprising:

upstream main paths for cylinders that are attached to a side of a cylinder head and extend towards a side of the engine, and are connected to the respective cylinders;

a downstream main path in which the upstream main paths join so as to become one flow path;

a main catalytic converter provided on the downstream main path;

bypasses that are split from the upstream main paths or the downstream main path;

a bypass catalytic converter that is provided on the bypass; and flow path switching valves that open and close the upstream main paths so that exhaust discharged from the cylinders flows into the bypass, the bypass catalytic converter being provided below the upstream main paths, the bypass catalytic converter being surrounded by upper arch portions of the upstream main paths that transverse the bypass catalytic converter.

8. An exhaust system for an engine having a plurality of exhaust ports for diverting exhaust gasses away from the engine, the system comprising:

a downstream main path, wherein at least a portion of gasses that flow through more than one of the plurality of exhaust ports selectively flows through the downstream main path;

a plurality of upstream main paths, wherein each of the plurality of upstream main paths interconnects each of the plurality of exhaust ports to the downstream main path;

a confluence point interposed between the plurality of upstream main paths and the downstream main path, wherein exhaust gasses from more than one of the plurality of upstream main paths selectively converge within the confluence point;

a bypass for selectively directing at least a portion of the exhaust gasses;

a plurality of bypass path portions, wherein each bypass portion interconnects one of the upstream main paths with the bypass, wherein at least a portion of the gas flowing through the bypass path portions converge to flow through the bypass;

a plurality of valves positioned at the plurality of upstream main paths, respectively, with the valves being configurable between a closed configuration and an open configuration, and with at least a portion of the exhaust gasses being not permitted to flow through the confluence point when the valves are in the closed configuration; and a first catalytic converter within the bypass such that at least a portion of the gasses that flow through the bypass flow through the first catalytic converter, at least a portion of the plurality of upstream main paths being positioned above and beside the first catalytic converter.

9. The exhaust system according to claim 8, wherein the exhaust system does not restrict flow through the bypass with any of the valves when the valves are in any configuration.

10. The exhaust system according to claim 9, wherein the exhaust ports are formed in a single cylinder head.

11. The exhaust system according to claim 9, further comprising a second catalytic converter within the downstream main path.

12. The exhaust system according to claim 11, wherein the bypass is connected to the downstream main path between the confluence point and the second catalytic converter.

13. The exhaust system according to claim 9, further comprising a third catalytic converter within the bypass.

14. An exhaust system for an engine having a plurality of exhaust ports for diverting exhaust gasses away from the engine, the exhaust system comprising:

a downstream main path, wherein at least a portion of gasses that flow through more than one of the plurality of exhaust ports selectively flows through the downstream main path;

a first upstream main path, wherein the first upstream main path interconnects one of the plurality of exhaust ports to the downstream main path;

a second upstream main path, wherein the second upstream main path interconnects a second one of the plurality of exhaust ports to the downstream main path;

a confluence point interposed between the first upstream main path and the downstream main path, wherein exhaust gasses from the first upstream main path and the second upstream main path selectively converge within the confluence point;

a bypass for selectively directing at least a portion of the exhaust gasses;

a first bypass path portion, wherein the first bypass path portion interconnects the first upstream main path with the bypass;

a second bypass path portion, wherein the second bypass path portion interconnects the second upstream main path with the bypass, wherein at least a portion of the gas flowing through the first bypass path portion and the second bypass path portion converge to flow through the bypass;

a first valve configurable between a closed configuration and an open configuration, and wherein the exhaust gasses flowing through the first upstream main path are diverted to flow through the first bypass path portion when the first valve is in the closed configuration;

a second valve configurable between a closed configuration and an open configuration, and wherein the exhaust gasses flowing through the second upstream main path are diverted to flow through the second bypass path portion when the second valve is in the closed configuration; and a first catalytic converter within the bypass such that at least a portion of the gasses that flow through the bypass flow through the first catalytic converter, and at least a portion of the first catalytic converter is positioned between the engine and at least one of the first upstream main path and the second upstream main path.

15. The exhaust system according to claim 14, further comprising:

a third upstream main path, wherein the third upstream main path interconnects a third one of the plurality of exhaust ports to the downstream main path;

a third bypass path portion, wherein the third bypass path portion interconnects the third upstream main path with the bypass, wherein at least a portion of the gas flowing through the first bypass path portion and the third bypass path portion converge to flow through the bypass; and a third valve configurable between a closed configuration and an open configuration, and wherein the exhaust gasses flowing through the third upstream main path are diverted to flow through the third bypass path portion when the third valve is in the closed configuration.

16. The exhaust system according to claim 14, further comprising a second catalytic converter within the downstream main path.

17. The exhaust system according to claim 14, wherein at least a portion of the plurality of upstream main paths are positioned above and beside the first catalytic converter.

* * * * *